US005435256A

United States Patent [19]

Svehaug

[11] Patent Number: 5,435,256

[45] Date of Patent: Jul. 25, 1995

[54] REFRIGERATOR SAFE BOX

[76] Inventor: Oswald C. Svehaug, 125 N. Glover, Chula Vista, Calif. 91910

[21] Appl. No.: 85,926

[22] Filed: Jul. 6, 1993

[51] Int. Cl.[6] ..... E05G 1/024

[52] U.S. Cl. ..... 109/65; 109/75; 109/80; 220/428; 220/366.1

[58] Field of Search ..... 109/27, 65, 75, 80, 109/84; 220/428, 360, 366, 412, 426; 70/DIG. 81; 206/457; 446/76; D99/30, 34–40; 312/204, 409

[56] References Cited

U.S. PATENT DOCUMENTS

| | | | |
|---|---|---|---|
| 1,383,838 | 7/1921 | Mrazek | 206/457 X |
| 1,388,094 | 8/1921 | Buttigieg | 206/457 X |
| 2,569,958 | 10/1951 | Struve et al. | 220/428 X |
| 2,654,856 | 10/1953 | Toulon | 220/428 X |
| 3,181,720 | 5/1965 | Cassie et al. | 220/366 X |
| 3,641,992 | 2/1972 | Peyser et al. | 220/428 X |
| 4,263,365 | 4/1981 | Burgess et al. | 109/76 X |
| 4,331,127 | 5/1982 | Grosso | 220/428 X |
| 4,422,386 | 12/1983 | Carpenter | 109/65 X |
| 4,512,498 | 4/1985 | Leibinger | 220/366 X |
| 4,630,671 | 12/1986 | Sherman et al. | 220/428 X |
| 4,721,227 | 1/1988 | Hughes et al. | 109/84 X |
| 5,121,852 | 6/1992 | Wilkes | 220/366 |
| 5,346,066 | 9/1994 | Jones | 70/456 R X |

FOREIGN PATENT DOCUMENTS

| | | | |
|---|---|---|---|
| 312737 | 6/1929 | United Kingdom | 220/428 |
| 337614 | 11/1930 | United Kingdom | 220/428 |
| 1257666 | 12/1971 | United Kingdom | 206/457 |

*Primary Examiner*—Lloyd A. Gall
*Attorney, Agent, or Firm*—Ralph S. Branscomb

[57] ABSTRACT

A box for containing valuables and particularly paper valuables and such which are susceptible to heat damage. It is made in the shape of a food item and kept in the refrigerator. The sidewalls, as well as optionally the bottom or top of the box, are preferably insulated with heat sink material with the preferred embodiment incorporating a water jacket filled with standing water to absorb heat and buy time in a fire as it vaporizes.

11 Claims, 1 Drawing Sheet

REFRIGERATOR SAFE BOX

BACKGROUND OF THE INVENTION

During a serious fire virtually everything is damaged that has not been specially protected, and much is totally destroyed. In a fire of this nature, it is almost universally found that the one spot within the dwelling in a house fire that survived largely untouched by the heat is the refrigerator compartment. The insulated walls of the refrigerator last long enough so that except in the worst of fires, the fire is out before the temperature within the refrigerator approaches the flash point of paper. In fact, it is common to find frozen foods that are still frozen after the rest of the house has been incinerated.

The refrigerator, therefore, would be a good place to store compact valuables which are susceptible to heat damage or destruction such as wills, bond certificates, stock certificates, rare currency bills, etc. Rather than putting the items loosely in a refrigerator or in a shoe box, with the incumbent problem that it would soon become apparent to all that valuables are kept in a box in the refrigerator, it would be desirable to disguise the cache somehow and at the same time provide an additional layer of protection against fire even beyond the walls of the refrigerator.

SUMMARY OF THE INVENTION

The instant invention fulfills the above stated goals by providing a safe box in the shape of a loaf of bread or some other food item. What appears to be a loaf of bread is in reality a container, preferably a ceramic container with thick walls which are insulative and preferably define a water jacket and a lid also containing insulative material and possibly defining a water jacket.

The "decoy" loaf of bread will reside in the refrigerator and hopefully deceive any thieves until in the unfortunate event of a major fire it is called into service.

Throughout a severe fire, the water jacket construction coupled with the ceramic composition of the container and the fact that it is within a refrigerator provides layers of protection for documents and other valuables against heat that should withstand the advances of any non-industrial conflagration.

DETAILED DESCRIPTION OF THE PREFERRED EMBODIMENT

Figure 1:
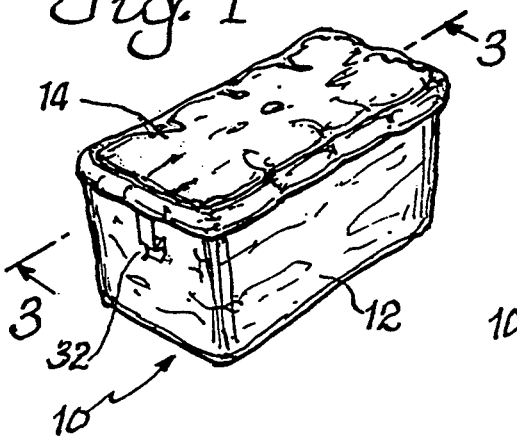
FIG. 1 is a perspective view of the invention in its completed form with the lid in place.
Figure 2:
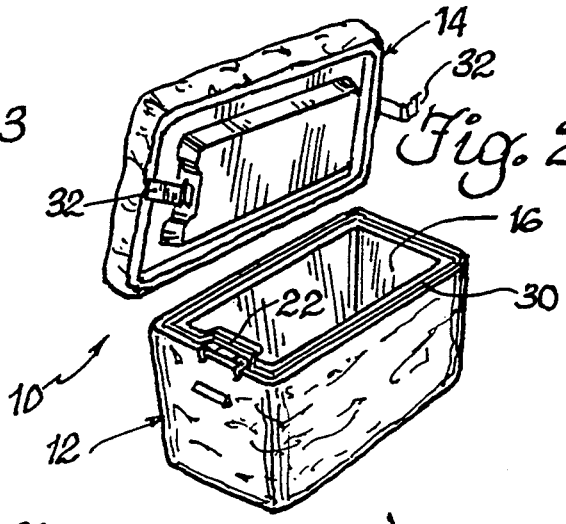
FIG. 2 is a perspective view substantially identical to FIG. 1 but with the lid removed.
Figure 3:
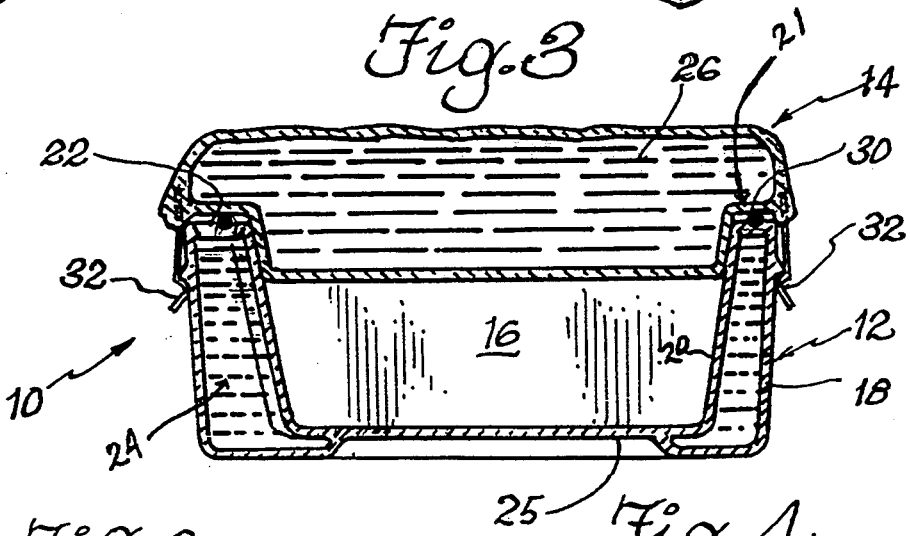
FIG. 3 is a section taken along 3—3 of FIG. 1.
Figure 6:
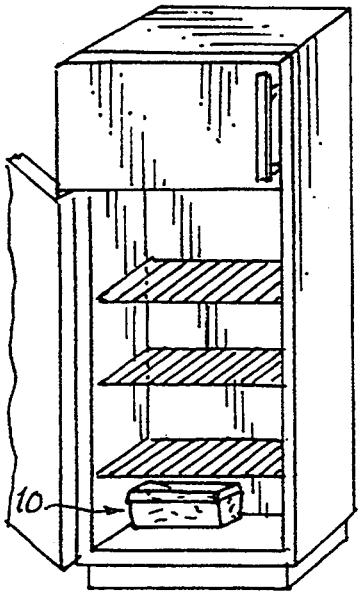
FIG. 6 is a diagrammatic illustration of a refrigerator with the invention inside in a typical arrangement.
Figure 4:
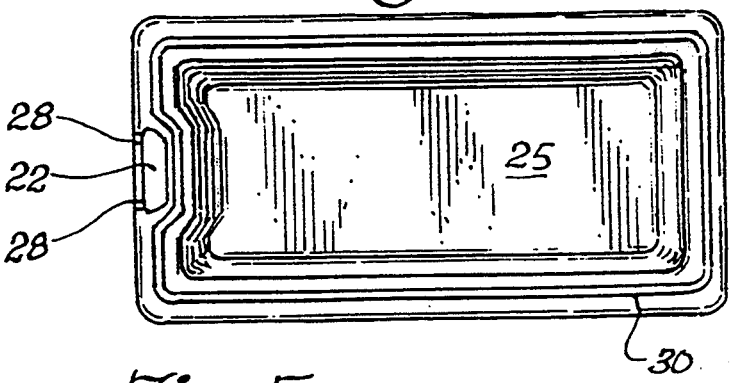
FIG. 4 is a top plan view of the container with the lid removed.
Figure 5:
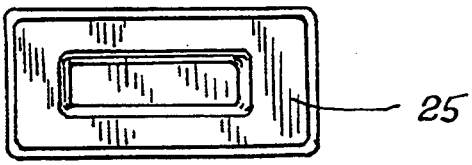
FIG. 5 is a bottom plan view of the invention.

The valuables box is illustrated at 10 in FIGS. 1 and 2 in perspective. It is made from two parts, the body 12 and the lid 14, which together define the container of the invention. Within the container is the internal cavity 16 into which valuables, particularly paper valuables, are intended to be kept.

Often valuables of this type, wills and stock certificates, etc, are folded to the size of a business-size envelope or slightly smaller, so the dimensions of the internal cavity at least in one plane should be slightly larger than 4.5"×9". The third dimension would be independent, depending on the capacity of the box.

Both of the parts of the container are preferably molded ceramic pieces. The art of molding ceramics is mature and items of the nature of that shown in the figures can be readily mass produced at minimal cost. The ceramic material itself is not expensive so that the unit shown could be produced, wholesale and then retail at a price low enough to encourage the purchase for one who had a need for the box.

Although the box could be made with walls thin enough to be solid ceramic (and not dry with wrinkles and cracks), or they could be hollow and filled with an insulated material, in the preferred embodiment the walls 18 define a continuous water jacket, having a continuous upper lip 21 defining a fill water inlet 22 so that all or a considerable part of the water jacket can be filled with water, as shown at 24. The lid 14 could be similarly configured, although not shown in the figures. The internal space 26 of the lid could be filled with an insulating material or made into a water jacket, similar to the water jacket 20. The floor 25 across the bottom edges of the walls completes the enclosure.

Forming cavities of this nature within molded ceramics presents no problem at all to the professional mold maker. "Lost wax" means of forming cavities and later draining the plugs or mandrels, etc., after they have melted is a relatively inexpensive process and is commonly done. A water jacket in any desired configuration could be formed in this fashion.

To prevent the steam generated in a fire from steaming the documents, vent holes or furrows 28 may be created alongside the inlet opening 22 or other appropriate place. A gasket or sealing ring 30 may seal between the two parts of the container, such that the gasket lies between the vents and the internal compartment and all water passageways are separated from the document compartment with a seal. Locks 32 are optional, but serve the purposes of deterring snoops and holding the safe box together in case it is jostled around, for example if the floor caves in.

The external configuration of the illustrated embodiment is formed to appear as a loaf of bread. Ceramic forming and surface finishing is available such that the unit could be made to look like an actual loaf of bread rather than a ceramic molding that's supposed to look like a loaf of bread. The purpose of this of course is first to present a more appealing scene to the owner of the refrigerator than would be the case if loose papers or a shoebox were shoved in among the lettuce and turnips. Of course, the other purpose is to thwart thieves. This might seem like a lot to ask, but bearing in mind the dynamics of a burglary, the burglar or burglars would be moving fast, glancing quickly and furtively into various containers and compartments in the house trying to find obvious clues as to where any valuables might be hidden. In the darkness deep inside a refrigerator an apparent loaf of bread would not likely spur their interest.

However, the invention is not primarily for the purpose of providing security by fooling burglars, but rather to avoid fire damage in a major blaze. Configuring the item as a food article is secondary to this double purpose.

Other forms of the container are of course possible. The variety of food items that the container could imitate is limitless. If not limited by an artificial size constraint, turnips, cheese slabs, milk cartons, or anything else that has at least a minimum size adequate to hold enough heat sink water to be of use and also provide serviceable valuables storage cavity could be used. Although ceramics are ideally suited for relatively small run items of this nature, the invention is not limited to ceramics. It is relatively important to the invention, however, that a heat sink material which sublimates at a temperature well below the flame point of paper be incorporated into the unit. Water is the ideal choice inasmuch as it is readily available and it has ideal qualities of sublimating at 212 degrees fahrenheit, and absorbing a large measure of heat for every vaporized unit volume. However, the essence of the invention is a container configured to resemble a food product having a sublimating heat sink material contained in a cavity or cavities defined in the sidewall and/or other portions of the containers to extend the life of valuables caught in a major fire well beyond what it would be in the bare refrigerator.

It is hereby claimed:

1. A valuables box for use in a refrigerated compartment comprising:

(a) an operable substantially sealed container dimensioned to fit unobtrusively within a household refrigerator;

(b) said container defining walls of substantial thickness compared to the overall thickness of said container and being heat insulative;

(c) said walls defining an internal cavity for holding valuables, and at least one heat sink compartment extending at least partway around said cavity to isolate same from ambient temperature spikes and including a heat sink material disposed within said compartment to act as a temperature ballast in said container in case of fire to constrain the temperature rise in said container as the temperature in said heat sink compartment rises; and (d) said container being externally configured to resemble a food item.

2. A valuables box according to claim 1 wherein said heat sink compartment is waterproof and defines a water jacket and including water disposed to act as said heat sink material, to substantially cap the temperature of said container at near the boiling point of water until such point as said water has vaporized.

3. A valuables box according to claim 2 wherein said water jacket is substantially continuous around said container to permit the free communication of water throughout said water jacket to prevent hot spots from occurring in the event of a fire.

4. A valuables box according to claim 3 wherein said walls of said container substantially surround said cavity and said compartment has a floor at the lower edges of said walls and a hollow lid spanning across the top of said cavity at the top edges of said walls which defines an internal water compartment.

5. A valuables box according to claim 2 wherein said container defines steam vents communicating between said water jacket and outside of said container.

6. A valuables box according to claim 5 wherein said container has a body and a lid and including a gasket disposed between said body and lid internally of said vents defining a substantial seal between said cavity and externally of said container.

7. A valuables box according to claim 6 wherein said container defines locking means for locking said lid to said body and compressing said gasket therebetween.

8. A valuables box according to claim 7 wherein said body has a substantially continuous upper lip supporting said gasket and a water inlet communicating with said water jacket outside said gasket such that said inlet is non-communicative with said cavity.

9. A valuables box according to claim 8 wherein said upper lip has at least one steam vent furrow between said water inlet and externally of said container.

10. A valuables box according to claim 1 wherein said container is dimensioned to accommodate business papers in standard business size envelopes and said cavity is substantially in the shape of a parallelopiped with at least one planar dimension being at least 4.5″×9″.

11. A valuables box according to claim 10 wherein said valuables box is externally configured to resemble a loaf of bread.

* * * * *